US009623541B2

(12) United States Patent
Srihari et al.

(10) Patent No.: US 9,623,541 B2
(45) Date of Patent: Apr. 18, 2017

(54) ABRASIVE FLAP WHEELS INCLUDING HYBRID FABRICS

(71) Applicants: SAINT-GOBAIN ABRASIVES, INC., Worcester, MA (US); SAINT-GOBAIN ABRASIFS, Conflans-Sainte-Honorine (FR)

(72) Inventors: Srirangapattana Narasimhaiah Srihari, Bangalore (IN); Selvaraj Prabu, Bangalore (IN); Abdul Habid Pullichola, Kerale (IN); Kottotil Mohan Das, Bangalore (IN)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

(21) Appl. No.: 14/978,063

(22) Filed: Dec. 22, 2015

(65) Prior Publication Data

US 2016/0184974 A1 Jun. 30, 2016

(30) Foreign Application Priority Data

Dec. 24, 2014 (IN) ..... 6528/CHE/2014

(51) Int. Cl.
*B24D 13/04* (2006.01)
*B24D 11/00* (2006.01)

(52) U.S. Cl.
CPC ..... *B24D 13/04* (2013.01); *B24D 11/001* (2013.01); *B24D 11/006* (2013.01)

(58) Field of Classification Search
CPC ... B24D 3/02; B24D 3/28; B24D 9/02; B24D 11/001; B24D 11/02; B24D 13/04; B24D 13/05; B24D 13/06; B24D 11/006
See application file for complete search history.

(56) References Cited

U.S. PATENT DOCUMENTS

| | | | | |
|---|---|---|---|---|
| 3,778,241 | A | 12/1973 | Winter et al. | |
| 3,857,750 | A * | 12/1974 | Winter | B24B 39/006 428/323 |
| 4,282,011 | A * | 8/1981 | Terpay | B24D 11/02 139/420 C |
| 5,490,878 | A | 2/1996 | Peterson et al. | |
| 6,672,952 | B1 | 1/2004 | Masmar et al. | |
| 6,726,555 | B2 * | 4/2004 | Eisenblaetter | B24D 3/344 451/490 |
| 9,108,299 | B2 * | 8/2015 | Moren | B24D 3/34 |
| 2008/0220703 | A1 * | 9/2008 | Jung | B24D 11/02 451/539 |

FOREIGN PATENT DOCUMENTS

| | | |
|---|---|---|
| KR | 100469222 B1 | 1/2005 |
| WO | WO-2016106336 A1 | 6/2016 |

OTHER PUBLICATIONS

International Search Report from PCT/US2015/067415 dated Apr. 1, 2016, 1 pg.

* cited by examiner

*Primary Examiner* — Timothy V Eley
(74) *Attorney, Agent, or Firm* — Abel Law Group, LLP; Joseph P Sullivan

(57) ABSTRACT

This invention relates to abrasive flap wheel that include hybrid fabrics. This invention also relates to methods of making and using said abrasive flap wheels. The claimed processes and systems related to the use and manufacturing of abrasive flaps are improved and cost effective.

20 Claims, 12 Drawing Sheets

ABRASIVE FLAP WHEELS INCLUDING HYBRID FABRICS

CROSS-REFERENCE TO RELATED APPLICATION

The application claims priority under 35 U.S.C. §119(a)-(d) to, and incorporates herein by reference in its entirety for all purposes, Indian Application 6528/CHE/2014, filed Dec. 24, 2014, entitled "ABRASIVE FLAP WHEELS INCLUDING HYBRID FABRICS", to Srirangapattana Narasimhaiah SRIHARI et al., which application is incorporated by reference herein in its entirety.

FIELD OF DISCLOSURE

The present invention relates generally to abrasive flap wheels including polymer reinforced hybrid fabrics and methods of making and using the abrasive flap wheels.

BACKGROUND

Abrasive flap wheels are used to provide a resilient, but positive, abrading action on a workpiece. Abrasive flap wheels are formed from a plurality of abrasive flaps each including a backing member and abrasive particles adhered to the backing member. The flaps are generally disposed in an annular array to form a wheel which is supported by a rotary member such as a hub of generally cylindrical form. The wheel is rotated to obtain a rotation of the flaps against a work piece. As the individual flaps impinge on the workpiece an abrading action is provided on the workpiece.

Conventional abrasive flap wheels can suffer from one or more of certain significant disadvantages, including uneven flap wear, excessive flap wear, thermal degradation, limited life span, limited material removal rate, and unacceptable surface finish.

Various approaches have been attempted to solve these problems but all suffer from certain drawbacks. Therefore, there continues to be a demand for improved abrasive flap wheels.

BRIEF DESCRIPTION OF THE DRAWINGS

The present disclosure can be better understood, and its numerous features and advantages made apparent to those skilled in the art by referencing the accompanying drawings.

The use of the same reference symbols in different drawings indicates similar or identical items.

DETAILED DESCRIPTION

Figure 1:
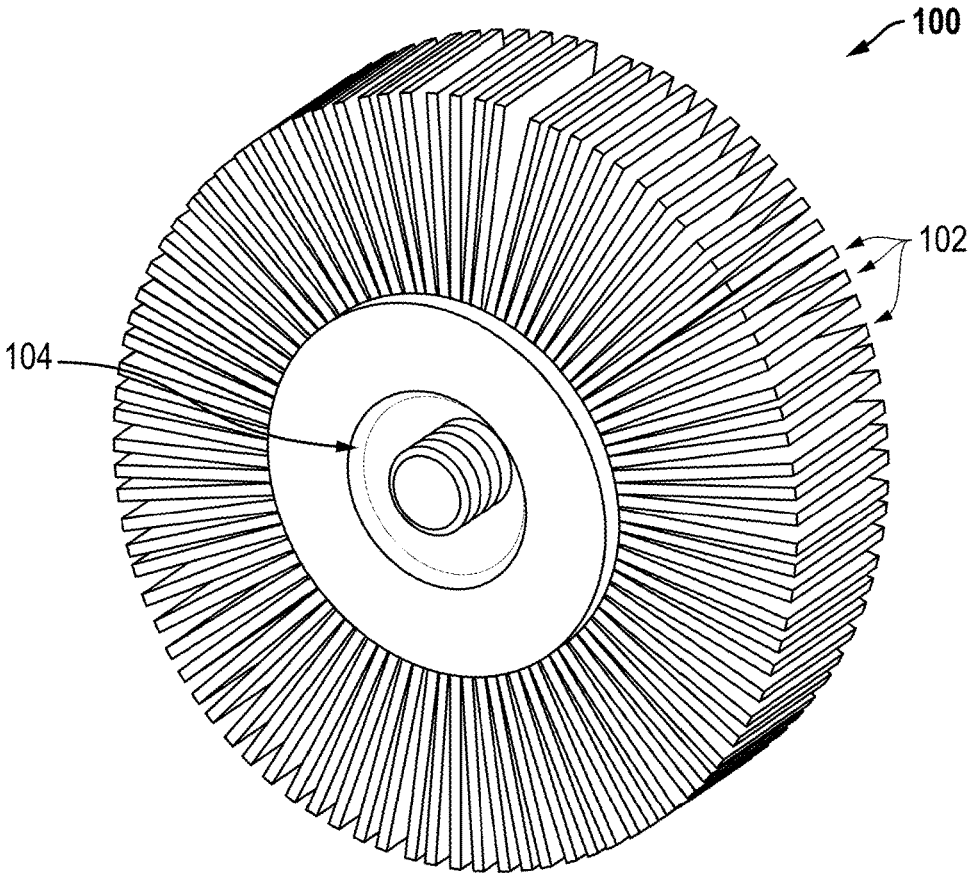
FIG. 1 is an illustration of an embodiment of an abrasive flap wheel.

The following description, in combination with the figures, is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

As used herein, the phrase "average particle diameter" can be reference to an average, mean, or median particle diameter, also commonly referred to in the art as D50.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the flap wheel abrasive arts.

FIG. 1 shows a photograph of an abrasive flap wheel 100 embodiment. The abrasive flap wheel comprises a plurality of abrasive flaps 102 disposed circumferentially about a hub 104.

Figure 2:
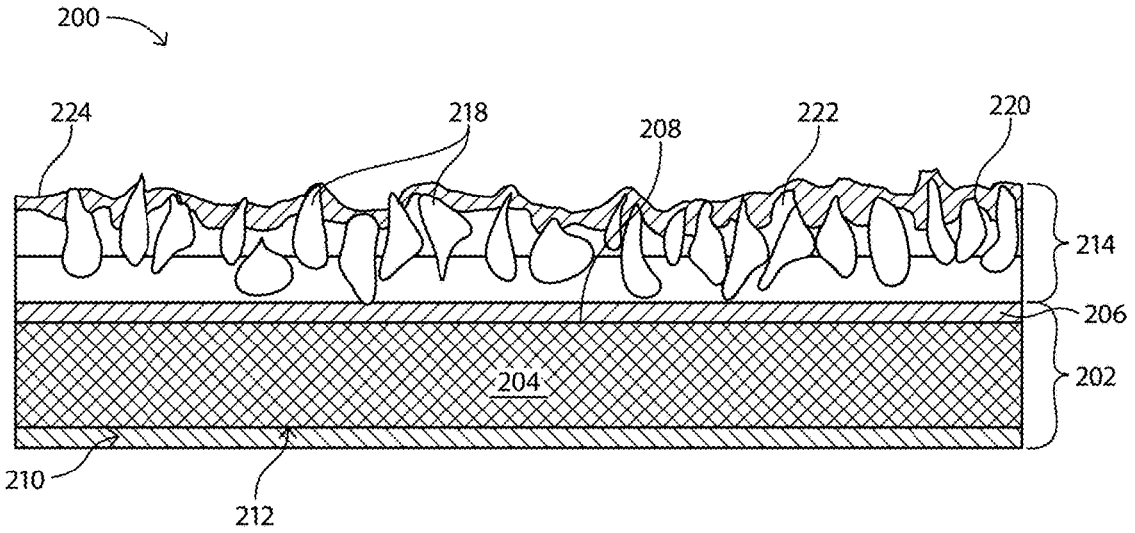
FIG. 2 is an illustration of a cross-sectional view of an embodiment of an abrasive flap of a flap wheel that includes a polymer reinforced hybrid fabric.

FIG. 2 shows an illustration of a cross section of an abrasive flap 200 embodiment comprising an abrasive layer 214 disposed on a fabric backing 202. The fabric backing 202 is comprised of a polymer reinforced (also called herein "polymer impregnated") fabric 204, such as a woven fabric, having a front fill layer 206 that is disposed on a first side 208 of the polymer reinforced woven fabric and a back fill layer 210 that is disposed on a second side 212 of the polymer reinforced fabric. The abrasive layer 214 comprises abrasive particles 218 disposed on or dispersed in a binder composition 220 (e.g., a "make coat" or an abrasive "slurry coat"). An optional size coat 222 is disposed on the abrasive layer. An optional supersize coat 224 is disposed on the size coat.

Figure 3:
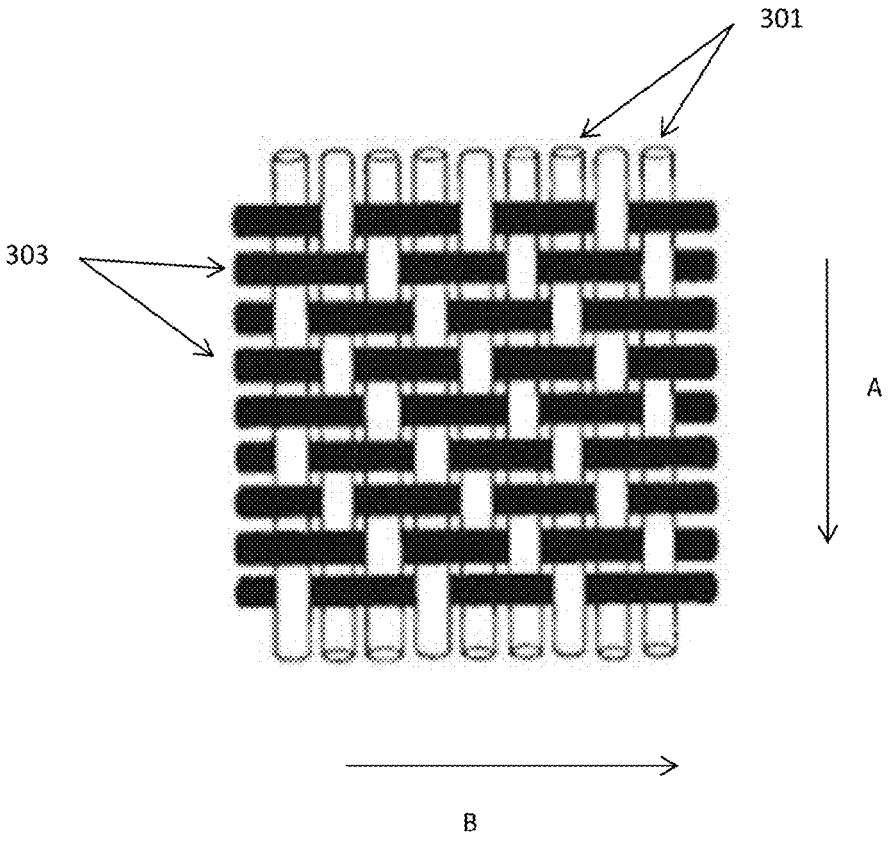
FIG. 3 is an illustration of a twill weave hybrid fabric embodiment for an abrasive flap wheel.
Figure 4:
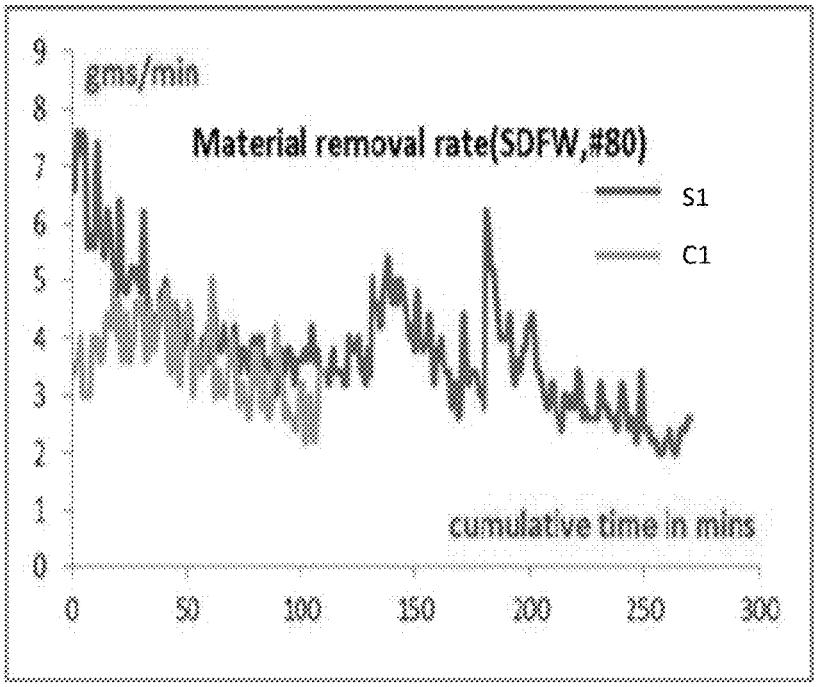
FIG. 4 is a graph comparing the material removal rate of an abrasive flap wheel embodiment that includes a polymer reinforced hybrid fabric to a conventional abrasive flap wheel.
Figure 5:
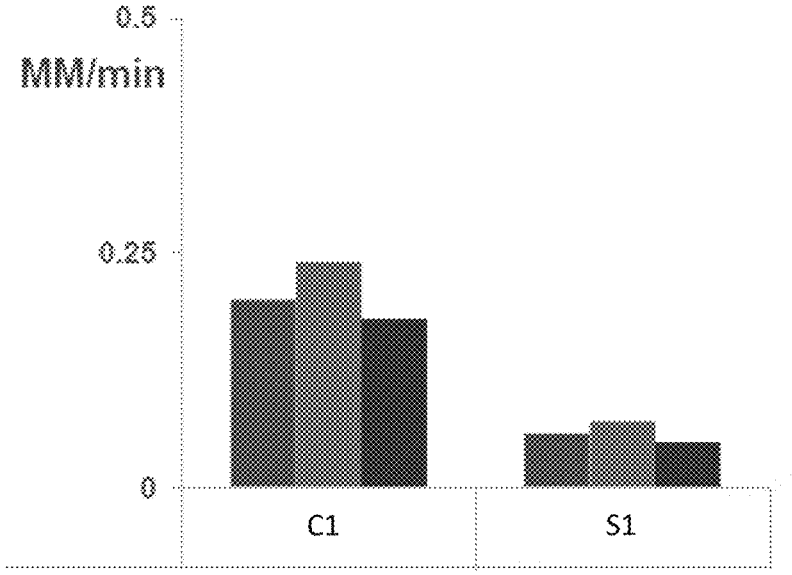
FIG. 5 is a bar chart comparing the wear of abrasive flap wheel embodiments of various grit sizes that include a polymer reinforced hybrid fabric with conventional abrasive flap wheels.

FIG. 3 shows an illustration of a woven fabric 300 comprised of yarns 301 in a warp direction (A) and yarns 303 in a weft direction (B). The yarns 301 in the warp direction comprise a blend of natural fibers and synthetic fibers. The yarns 303 in the weft direction comprise natural fibers.

Fabric Backing

A fabric backing can comprise a polymer reinforced fabric having a front fill composition disposed on a first side of the polymer reinforced fabric and a back fill composition disposed on a second side of the polymer reinforced fabric. The fabric backing possesses beneficial physical properties that contribute to unexpected beneficial and superior abrasive performance of abrasive flap wheels that include the fabric backing.

Polymer Reinforced Fabric

The fabric backing comprises a fabric reinforced with (also referred to herein as "saturated with" or "impregnated with") a reinforcing polymeric composition (also called herein a "dip fill" composition, a "saturating" composition, or a "saturant" composition). The reinforcing polymer composition can be dispersed throughout the fabric.

The fabric can be a woven fabric, a nonwoven fabric, or a combination thereof. In an embodiment, the fabric is a woven fabric. A woven fabric can possess one or more particular weaves. In an embodiment, the woven fabric can comprise a plain weave, a satin weave, a twill weave, or a combination thereof. In a particular embodiment, the woven fabric comprises a 2 up 1 down twill weave.

The fabric comprises yarns in a warp direction and yarns in a weft direction. In an embodiment, the yarns in the warp direction comprise a blend of natural fibers and synthetic fibers. In an embodiment, the yarns in the weft direction comprise natural fibers. In an embodiment, each of the yarns in the weft direction comprises at least one natural fiber, wherein the at least one natural fiber comprises a cut filament, a continuous filament, or a combination thereof. In an embodiment, the yarns in the warp direction comprise at least one natural fiber and at least one synthetic fiber, wherein at least one natural fiber and at least one synthetic fiber comprise cut filaments, continuous filaments, or a combination thereof.

In an embodiment, the yarns in the weft direction comprise natural fibers. In an embodiment, the yarns in the weft direction comprise at least about 50% natural fibers, at least about 60% natural fibers, at least about 75% natural fibers, at least about 85% natural fibers, at least about 95% natural fibers, at least about 99% natural fibers. In another embodiment, the yarns in the weft direction consist essentially of natural fibers.

In an embodiment, the yarns in the warp direction comprise at least about 30% synthetic fibers, at least about 40% synthetic fibers, at least about 50% synthetic fibers, at least about 60% synthetic fibers, at least about 75% synthetic fibers, at least about 85% synthetic fibers, at least about 95% synthetic fibers. In another embodiment, the yarns in the warp direction comprise approximately 65% synthetic fibers.

In an embodiment, the yarns in the warp direction comprise less than about 70% natural fibers, less than about 60% natural fibers, less than about 50% natural fibers, less than about 40% natural fibers, less than about 25% natural fibers, less than about 10% natural fibers, less than about 55% natural fibers. In an embodiment, the yarns in the warp direction comprise approximately 35% natural fibers.

The natural fibers can comprise one or more natural fibers. In an embodiment, the natural fibers can comprise cellulose, cotton, flax, hemp, jute, ramie, sisal, linen, silk, or a combination thereof. In another embodiment, the natural fibers comprise cotton. In a specific embodiment, the natural fibers consist essentially of cotton.

The synthetic fibers can comprise one or more synthetic fibers. In an embodiment, the synthetic fibers can comprise polymer, glass, metal, rubber, carbon, or a combination thereof. In another embodiment, the synthetic fibers comprise polymer. In another embodiment, the polymer comprises nylon, acrylic, olefin, polyester, rayon, modal, Dyneema, or a combination thereof. In a particular embodiment, the polymer comprises polyester. In a specific embodiment, the synthetic fibers consist essentially of polyester.

The yarns in the fabric can have a particular construction. In an embodiment, the yarns in the fabric can comprise a spun yarn, a plied yarn, a braided yarn, a roving, a twisted yarn, a flat yarn, a cabled yarn, a tow, or a combination thereof.

The fabric can be described according to the number of yarns in the warp direction and the number of yarns in the weft direction ("warp×weft"). In an embodiment, the fabric can comprise a yarn number of approximately 12×16, approximately 16×16, approximately 21×21, approximately 16×21, or approximately 40×40. In a specific embodiment, the yarn number is 12×16.

The fabric can be described as having a "count" (i.e., the number of threads per 25 mm in the warp direction and in the weft direction (warp×weft). In a specific embodiment, the fabric can comprise a count of approximately 78×48.

The fabric can be described as having a particular number of warp yarns per inch. In an embodiment, the fabric comprises at least about 20 warp yarns per inch, at least about 30 warp yarns per inch, at least about 40 warp yarns per inch, at least about 50 warp yarns per inch, at least about 60 warp yarns per inch, at least about 75 warp yarns per inch, at least about 85 warp yarns per inch. In a particular embodiment, the fabric comprises at least about 78 warp yarns per inch.

The fabric can be described as having a particular number of weft yarns per inch. In an embodiment, the fabric comprises at least about 5 weft yarns per inch, at least about 10 weft yarns per inch, at least about 20 weft yarns per inch, at least about 30 weft yarns per inch, at least about 40 weft yarns per inch, at least about 50 weft yarns per inch, at least about 60 weft yarns per inch. In a particular embodiment, the fabric comprises at least about 48 weft yarns per inch.

The fabric can possess a particular "weight" (mass per unit area), such as g/m$^2$ (abbreviated herein as "GSM"). In an embodiment, the fabric comprises a fabric weight of not less than 50 GSM, not less than 75 GSM, not less than 100 GSM, or not less than 125 GSM. In an embodiment, the fabric comprises a fabric weight of not greater than 500 GSM, not greater than 400 GSM, not greater than 350 GSM, or not greater than 300 GSM. The weight of the fabric can be within a range comprising any pair of the previous upper and lower limits. In a particular embodiment, the weight of the fabric can be in the range of not less than 50 GSM to not greater than 500 GSM, such as not less than 75 GSM to not greater than 400 GSM, not less than 100 GSM to not greater than 350 GSM, or not less than 125 GSM to not greater than 300 GSM. In a specific embodiment, the weight of the fabric can be in the range of not less than 200 GSM to not greater than 300 GSM.

The fabric can have a particular tensile strength in the weft direction. In an embodiment, the tensile strength of the fabric in the weft direction can be not less than 1 kgf/25 mm, not less than 5 kgf/25 mm, not less than 10 kgf/25 mm, not less than 15 kgf/25 mm, or not less than 20 kgf/25 mm. In another embodiment, the tensile strength of the fabric in the weft direction can be not greater than 100 kgf/25 mm, not greater than 60 kgf/25 mm, not greater than 50 kgf/25 mm, or not greater than 40 kgf/25 mm. The tensile strength of the fabric can be within a range comprising any pair of the previous upper and lower limits. In a particular embodiment, the tensile strength of the fabric in the weft direction can be in a range of not less than 1 kgf/25 mm to not greater than 100 kgf/25 mm, such as 5 kgf/25 mm to 60 kgf/25 mm, such as 10 kgf/25 mm to 50 kgf/25 mm, or 15 kgf/25 mm to 40 kgf/25 mm.

The fabric can have a particular tensile strength in the warp direction. In an embodiment, the tensile strength of the fabric in the warp direction can be not less than 50 kgf/25 mm, not less than 55 kgf/25 mm, not less than 60 kgf/25 mm, not less than 65 kgf/25 mm, not less than 70 kgf/25 mm, or not less than 75 kgf/25 mm. In another embodiment, the tensile strength of the fabric in the warp direction can be not greater than 500 kgf/25 mm, not greater than 400 kgf/25 mm, not greater than 300 kgf/25 mm, or not greater than 200 kgf/25 mm. The tensile strength of the fabric can be within a range comprising any pair of the previous upper and lower limits. In a particular embodiment, the tensile strength of the fabric in the warp direction can be in a range of not less than 75 kgf/25 mm to not greater than 500 kgf/25 mm.

The fabric can have a particular tensile strength in the weft direction and in the warp direction such that the tensile strength in the weft direction and tensile strength in the warp direction have a particular relationship to each other. In an embodiment, the tensile strength in the weft direction is greater than the tensile strength in the warp direction. In another embodiment, the tensile in the weft direction is less than the tensile strength in the warp direction. In another embodiment, the tensile strength in the weft direction is approximately the same as the tensile strength in the warp direction. In an embodiment, the tensile strength in the weft direction and in the warp direction can both be greater than a particular minimum value. In an embodiment, the tensile strength of the fabric in both the weft direction and in the warp direction can be not less than 20 kgf/25 mm.

The fabric can have a particular thickness. In an embodiment, the thickness of the fabric can be not less than 0.2 mm, such as not less than 0.4 mm, not less than 0.5 mm, not less than 0.6 mm, not less than 0.7 mm, not less than 0.8 mm, or not less than 0.9 mm. In another embodiment, the thickness of the fabric can be not greater than 10 mm, such as not greater than 9 mm, not greater than 7.5 mm, not greater than 5 mm, not greater than 4 mm, not greater than 2.5 mm, or not greater than 1 mm. The thickness of the fabric can be within a range comprising any pair of the previous upper and lower limits. In a particular embodiment, the thickness of the fabric can be in a range of not less than 0.2 mm to not greater than 10 mm.

The fabric can comprise any combination of the above features. In a specific embodiment, the fabric comprises a woven cloth with a twill weave and a fabric weight in a range of 200 to 300 g/m2.

Reinforcing Polymer Composition

As stated above, the fabric is impregnated with a reinforcing polymer composition. The polymer reinforced fabric can be described in terms of the reinforcing polymer composition when cured, partially cured, or fully cured.

A reinforcing polymer composition can be formed of a single polymer or a blend of polymers. The reinforcing polymer composition can comprise an acrylic polymer, a phenolic formaldehyde polymer, a melamine formaldehyde polymer, a urea formaldehyde polymer, or combinations and blends thereof. In an embodiment, the acrylic polymer is an acrylic latex polymer. The phenolic formaldehyde polymer, melamine polymer, or urea polymer can comprise a single prepolymer resin or a blend of resins. Phenolic formaldehyde polymers can comprise phenol formaldehyde resole resins. Resole resins are generally made using alkali hydroxides with a formaldehyde to phenol ratio of about 1.0 to 3.0 at a pH of 7 to 13. In an embodiment the reinforcing polymer composition comprises an acrylic resin, a urea formaldehyde resin, or a combination thereof.

In an embodiment, the reinforcing polymer composition can comprise:

3 wt % to 43 wt % acrylic resin and 57 wt % to 97 wt % urea formaldehyde resin, wherein the percentages are based on a total weight of the reinforcing polymer composition and all the percentages of the ingredients add up to 100 wt %. Optionally, from about 0.1 wt % to about 5 wt % of additives can also be included in the reinforcing polymer composition. If one or more additives are included, the amount of the other ingredients can be adjusted so that the total amounts of the ingredients in the reinforcing polymer composition adds up to 100 wt %.

Alternatively, the reinforcing polymer composition can be expressed as a ratio of the acrylic resin, such as an acrylic latex resin, and the urea formaldehyde resin. In an embodiment, the acrylic resin and the urea formaldehyde resin are present in a ratio (acrylic resin:urea formaldehyde resin) ranging from 1:9 to 9:1, such as from 1:5 to 5:1; from 1:4 to 4:1; from 1:3 to 3:1; or about 1:3.3.

It will be appreciated that the reinforcing polymer composition can be distributed uniformly or non-uniformly throughout the fabric. In an embodiment, the reinforcing polymer composition is uniformly dispersed throughout the fabric.

Amount of Impregnation (Saturation)—Add-on Weight

The amount of reinforcing polymer composition that impregnates (i.e., saturates) and reinforces the fabric (i.e., the amount of reinforcing polymer composition that adheres to and/or is absorbed by the fabric) is also known as the "add-on" weight of the reinforcing polymer composition. The amount of saturation can be expressed as "wet" add-on weight, which is the weight of the uncured reinforcing polymer composition and can include water. Alternatively, the amount of saturation can be expressed a "dry" add-on weight, which is the weight of the cured reinforcing polymer composition and does not include water. The amount of add-on weight, whether wet add-on weight or dry add-on weight, can be expressed as a percentage of the original weight of the backing. For example, if the fabric weighs: 100 g/m2 prior to impregnation; 150 g/m2 after impregnation (uncured); and 125 g/m2 after curing, then the impregnated fabric would be considered 50 wt % saturated "wet" and 25 wt % saturated "dry". Alternatively, the amount of impregnation can be expressed as the mass of the add-on weight of the reinforcing polymer composition. For example, if the fabric weighs: 100 g/m2 prior to saturation; weighs 150 g/m2 after saturation (uncured), and 125 g/m2 after curing, then the amount of saturation would be expressed as 50 g/m2 of wet add-on weight and 25 g/m2 of dry add-on weight of reinforcing polymer composition.

The dry add-on weight of the reinforcing polymer composition to the fabric can be in a particular range. In an embodiment, the dry add-on weight of the reinforcing polymer composition can be not less than 5 g/m2 (GSM), such as not less than 10 GSM, not less than 250 GSM, not less than 15 GSM, not less than 20 GSM, not less than 30 GSM, not less than 35 GSM, or not less than 40 GSM. In another embodiment, the dry add-on weight of the fabric can be not greater than 100 GSM, such as not greater than 90 GSM, not greater than 80 GSM, not greater than 70 GSM, not greater than 60 GSM, not greater than 55 GSM, or not greater than 50 GSM. The dry add-on weight of the fabric can be within a range comprising any pair of the previous upper and lower limits. In a particular embodiment, the dry add-on weight of the fabric can be in a range of not less than 10 GSM to not greater than 100 GSM.

The dry add-on weight of the reinforcing polymer composition can be a percentage of the weight of the unsaturated fabric. In an embodiment, the dry add-on weight of the reinforcing polymer composition can be not less than 5 wt %, such as not less than about 6 wt %, not less than about 7 wt %, not less than about 8 wt %, or not less than about 9 wt %. In another embodiment, the dry add-on weight of the fabric can be not greater than 20 wt %, such as not greater than 19 wt %, not greater than 18 wt %, not greater than 17 wt %, not greater than 16 wt %, not greater than 15 wt %, or not greater than 14 wt %. The dry add-on weight of the reinforcing polymer composition can be within a range comprising any pair of the previous upper and lower limits. In a particular embodiment, the dry add-on weight of the reinforcing polymer composition can be in a range of not less than 5 wt % to not greater than 20 wt %.

Front Fill Layer

As stated above, the fabric backing comprises a polymer reinforced fabric having a front fill layer disposed on a first side of the polymer reinforced fabric. The front fill layer comprises a front fill composition (also called herein the "front fill composition"). The front fill composition can be described in terms of being cured, partially cured, or fully cured.

The front fill composition can be the same as or different from the reinforcing polymer composition as described above. The front fill composition can comprise a single resin or a mixture of a plurality of resins as described above. In an embodiment, the front fill composition comprises a mixture of an acrylic latex resin and a phenol formaldehyde resin.

The acrylic latex resin and phenolic formaldehyde resin can be in a particular ratio to each other. In an embodiment, the ratio of acrylic latex resin to phenolic formaldehyde resin (acrylic latex resin:phenol formaldehyde resin) is in a range of about 1:9 to 9:1, such as about 1:4.5 to 4.5:1, such as about 1:2 to 2:1, or about 1:1.

The front fill composition can further comprise, if desired, a filler material in an amount of 0 wt % to 50 wt % of the weight of the front fill composition. In a particular embodiment, the front fill composition is free of calcium carbonate.

In an embodiment, the front fill composition can comprise:

15 wt % to 50 wt % of acrylic resin;

50 wt % to 85 wt % of phenol formaldehyde resin;

wherein the percentages are based on a total weight of the front fill composition and all the percentages of the ingredients add up to 100 wt %. Optionally, from about 0.1 wt % to about 5 wt % of additives can also be added to the front fill composition. If one or more additives are included, the amount of the other ingredients can be adjusted so that the total amounts of the ingredients in the front fill composition adds up to 100 wt %.

The dry add-on weight of the front fill composition refers to the amount of cured front fill composition disposed on the first side of the polymer reinforced fabric. The dry add-on weight of the front fill composition to the fabric backing can be in a particular range. In an embodiment, the dry add-on weight of the front fill composition can be not less than 5 g/m2 (GSM), such as not less than 10 GSM, not less than 15 GSM, not less than 20 GSM, not less than 25 GSM, not less than 30 GSM, not less than 35 GSM, or not less than 40 GSM. In another embodiment, the dry add-on weight of the front fill composition can be not greater than 100 GSM, such as not greater than 90 GSM, not greater than 80 GSM, not greater than 70 GSM, or not greater than 60 GSM. The dry add-on weight of the front fill composition can be within a range comprising any pair of the previous upper and lower limits. In a particular embodiment, the dry add-on weight of the front fill composition can be in a range of not less than 5 GSM to not greater than 100 GSM.

Backfill Layer

As stated above, the fabric backing comprises a polymer reinforced fabric having a back fill layer disposed on a second side of the polymer reinforced fabric. The back fill layer comprises a back fill composition (also called herein the back fill composition). The back fill composition can be the same as or different from the reinforcing polymer composition or the front fill compositions as described above. The back fill composition can comprise acrylic resin, a phenolic formaldehyde resin, a melamine formaldehyde resin, a urea formaldehyde resin, a natural glue, a starch, or a combination thereof. The back fill composition can further comprise a filler.

In an embodiment, the back fill composition can comprise:

15 wt % to 50 wt % of a starch; and 50 wt % to 85 wt % of hide glue;

wherein the percentages are based on a total weight of the back fill composition and all the percentages of the ingredients add up to 100 wt %. Optionally, from about 0.1 wt % to about 5 wt % of additives can also be added to the back fill composition. If one or more additives are included, the amount of the other ingredients can be adjusted so that the total amounts of the ingredients in the front fill composition adds up to 100 wt %.

The dry add-on weight of the back fill composition refers to the amount of cured back fill composition disposed on the second side of the polymer reinforced fabric. The dry add-on weight of the back fill composition can be in a particular range. In an embodiment, the dry add-on weight of the back fill composition can be not less than 5 g/m2 (GSM), such as not less than 10 GSM, not less than 15 GSM, not less than 20 GSM, or not less than 25 GSM. In another embodiment, the dry add-on weight of the back fill composition can be not greater than 90 GSM, such as not greater than 80 GSM, not greater than 70 GSM, not greater than 60 GSM, not greater than 50 GSM, not greater than 40 GSM, or not greater than 30 GSM. The dry add-on weight of the back fill composition can be within a range comprising any pair of the previous upper and lower limits. In a particular embodiment, the dry add-on weight of the back fill composition can be in a range of not less than 5 GSM to not greater than 90 GSM.

Fabric Backing

The fabric backing can be described on a percent weight basis of the woven fabric, the reinforcing polymer composition, the front fill composition, and the back fill composition. In an embodiment, a completed fabric backing can comprise:

62 wt % to 76 wt % fabric;

9 wt % to 14 wt % reinforcing polymer composition;

10 wt % to 15 wt % front fill; and 5 wt % to 9 wt % back fill, wherein the percentages are based on the total weight of the fabric backing and all the percentages of the components add up to 100 wt %.

Beneficial Properties of a Fabric Backing

The fully cured fabric backing possesses physical properties that are surprisingly beneficial and that contribute to superior abrasive performance of an abrasive flap wheel that includes the fabric backing Method of Making a Fabric Backing Mixing a Reinforcing Polymer Composition A reinforcing polymer composition can comprise a polymeric composition as described above. The ingredients of the reinforcing polymer composition are thoroughly mixed together. Mixing can be conducted using high shear conditions, moderate shear conditions, low shear conditions, or combinations thereof. Typically, mixing occurs until the ingredients are thoroughly mixed.

During mixing of the reinforcing polymer composition, the ingredients can be added to the reinforcing polymer composition one by one, in batches, or all at once. Typically the ingredients are added one by one to the reinforcing polymer composition. If the ingredients are added one by one or in batches, the reinforcing polymer composition can be agitated for a period of time until the ingredient has sufficiently mixed into the reinforcing polymer composition. Typical agitation times range from about 1 minute to about 2 hours, depending on the ingredient or ingredients being added to the reinforcing polymer composition.

The temperature of the reinforcing polymer composition can be adjusted if desired during mixing. The temperature of the reinforcing polymer composition during mixing can be in a range of about 15° C. to about 45° C., such as about 20° C. to about 25° C. The pH of the reinforcing polymer composition can be adjusted during mixing. The pH can be adjusted by the addition of an acid, a base, a buffer solution, or a combination thereof if desired. The pH of the reinforcing polymer composition is typically basic, but can be close to neutral, such as in a range of about 7 pH to about 13 pH.

Water can be added to the reinforcing polymer composition in an amount to adjust or control the viscosity of the reinforcing polymer composition as desired. The viscosity of the reinforcing polymer composition can be monitored as it is being prepared. In an embodiment, the viscosity of the reinforcing polymer composition is adjusted to be within a particular range.

Saturating the Fabric

A suitable fabric, such as described above, can be saturated (also referred to herein as being "impregnated") with reinforcing polymer composition by any suitable manner that applies a sufficient amount of reinforcing polymer composition so that the fabric becomes thoroughly soaked with the reinforcing polymer composition. In an embodiment, saturation can be accomplished by dipping, spraying, submerging, coating, or washing the fabric with or in the reinforcing polymer composition, or combinations thereof. The saturation can occur as a single step or multiple steps, such as multiple dipping steps or multiple spraying steps of the fabric with the reinforcing polymer composition, or combinations thereof. In a specific embodiment, the fabric is dipped into a reinforcing polymer composition. In another embodiment a fabric is sprayed with a reinforcing polymer composition.

Adjusting Saturation

Adjusting the saturation of the reinforcing polymer composition can be accomplished by any method or mechanism that does not overly degrade the fabric. Suitable methods and mechanisms of adjusting the reinforcing polymer composition can re-apply and/or remove a desired amount of reinforcing polymer composition so that the fabric has a desired amount of saturation. Adjusting the amount of reinforcing polymer composition can be accomplished in a single step or multiple steps. Adjusting the amount of reinforcing polymer composition can include pressing, squeezing, brushing, squeegeeing, blowing, dabbing, blotting, rollering, shaking, or combinations thereof, and the like. In a specific embodiment, the polymer reinforced fabric can be squeezed, such as between a pair of rollers to adjust the saturation of the saturated backing.

Curing

After saturation of the fabric with reinforcing polymer composition, and any optional adjustment of the amount of saturation of the backing, the saturated or saturation adjusted pre-cure fabric can undergo curing, partially to fully, to form a fabric backing (i.e., The polymer reinforced fabric has been impregnated with cured polymeric saturation composition). Curing can be conducted in a single step or multiple steps. Curing can be accomplished by exposure to a heat source, such as a heating tunnel or oven, including a multi stage oven, or the like. Alternative heating sources can include exposure to infrared radiation lamps, or the like.

In an embodiment, the polymer reinforced fabric is cured at a particular temperature or temperature range. The add-on polymer reinforcing resin saturating the fabric is cured.

In another embodiment, the polymer reinforced fabric can be cured to a degree that the surface of the partially cured fabric is rendered tack free (i.e., not tacky, does not stick to fingers), but the partially cured fabric is still pliable and suitable for further processing.

Partially to fully curing the polymer reinforced fabric forms a completed polymer reinforced fabric.

Applying the Front Fill Layer

A front fill composition (front fill composition) as described above can be prepared by mixing together the required ingredients. The ingredients of the front fill composition are thoroughly mixed together. Mixing shear conditions, addition of ingredients, mixing temperature, and pH range of the composition are as described above with respect to the reinforcing polymer composition.

Water can be added to the front fill composition in an amount to adjust or control the viscosity of the front fill composition as desired.

The front fill layer can be applied to a first side of the polymer reinforced fabric by any suitable coating method or coating apparatus. Suitable coating apparatus can include a drop die coater, a knife coater, a curtain coater, a die coater, or a vacuum die coater. Coating methodologies can include either contact or non-contact coating methods. Suitable coating methods can include two roll coating, three roll reverse coating, knife over roll coating, slot die coating, gravure coating, rotary printing, extrusion, spray coating, or combinations thereof.

Curing the Front Fill Layer

The front fill composition can be cured partially to fully in the same manner as described above with respect the first polymer composition Applying the Back Fill Layer A back fill composition (back fill composition) as described above can be prepared by mixing together the required ingredients. The ingredients of the back fill composition are thoroughly mixed together. Mixing shear conditions, addition of ingredients, mixing temperature, and pH range of the composition are as described above with respect to the reinforcing polymer composition.

Water can be added to the back fill composition in an amount to adjust or control the viscosity of the front fill composition as desired. The viscosity of the back fill composition can be monitored as it is being prepared.

The back fill layer can be applied to a second side of the polymer reinforced fabric by any suitable coating method or coating apparatus. Suitable coating apparatus can include a drop die coater, a knife coater, a curtain coater, a die coater, or a vacuum die coater. Coating methodologies can include either contact or non-contact coating methods. Suitable coating methods can include two roll coating, three roll reverse coating, knife over roll coating, slot die coating, gravure coating, rotary printing, extrusion, spray coating, or combinations thereof.

Curing the Back Fill Layer

The back fill composition can be cured partially to fully in the same manner as described above with respect the first polymer composition.

Upon completion of the curing of the back fill layer the fabric backing is complete. The fabric backing can be stored or subjected to additional processing such as is required to construct an abrasive flap.

Preparation of an Abrasive Flap Wheel

The fabric backing can be used to make a flap wheel comprised of a plurality of abrasive flaps disposed about a central hub. In an embodiment, an abrasive flap is prepared by disposing an abrasive layer on the fabric backing. Optionally, a size coat, a supersize coat, a back coat or any other number of compliant or intermediary layers known in the art of making abrasive flaps can be applied to the abrasive flap.

Abrasive Layer

An abrasive layer can comprise a make coat or an abrasive slurry. The make coat or abrasive slurry can comprise a plurality of abrasive particles, also referred to herein as abrasive grains, retained by a polymer binder composition. The polymer binder composition can be an aqueous composition. The polymer binder composition can be a thermosetting composition, a radiation cured composition, or a combination thereof.

Abrasive Grains

Abrasive grains can include essentially single phase inorganic materials, such as alumina, silicon carbide, silica, ceria, and harder, high performance superabrasive grains such as cubic boron nitride and diamond. Additionally, the abrasive grains can include composite particulate materials. Such materials can include aggregates, which can be formed through slurry processing pathways that include removal of the liquid carrier through volatilization or evaporation, leaving behind green aggregates, optionally followed by high temperature treatment (i.e., firing) to form usable, fired aggregates. Further, the abrasive regions can include engineered abrasives including macrostructures and particular three-dimensional structures.

In an exemplary embodiment, the abrasive grains are blended with the binder formulation to form abrasive slurry. Alternatively, the abrasive grains are applied over the binder formulation after the binder formulation is coated on the backing. Optionally, a functional powder can be applied over the abrasive regions to prevent the abrasive regions from sticking to a patterning tooling. Alternatively, patterns can be formed in the abrasive regions absent the functional powder.

The abrasive grains can be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive grains can be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive grains comprised principally of alpha-alumina. In a particular embodiment, the abrasive grains comprise "blue fired" aluminum oxide, brown aluminum oxide, or a combination thereof.

The abrasive grain can also have a particular shape. An example of such a shape includes a rod, a triangle, a pyramid, a cone, a solid sphere, a hollow sphere, or the like. Alternatively, the abrasive grain can be randomly shaped.

In an embodiment, the abrasive grains can have an average grain size not greater than 800 microns, such as not greater than about 700 microns, not greater than 500 microns, not greater than 200 microns, or not greater than 100 microns. In another embodiment, the abrasive grain size is at least 0.1 microns, at least 0.25 microns, or at least 0.5 microns. In another embodiment, the abrasive grains size is from about 0.1 microns to about 200 microns and more typically from about 0.1 microns to about 150 microns or from about 1 micron to about 100 microns. The grain size of the abrasive grains is typically specified to be the longest dimension of the abrasive grain. Generally, there is a range distribution of grain sizes. In some instances, the grain size distribution is tightly controlled. In a particular embodiment, the abrasive grain size can comprise a mixture of a plurality of desired abrasive grain sizes, such as from 60# grit to 120# grit, 150# grit to 1200# grit, or a combination thereof.

Binder—Make Coat or Abrasive Slurry Coat

The binder of the make coat or the size coat can be formed of a single polymer or a blend of polymers. For example, the binder can be formed from epoxy, acrylic polymer, or a combination thereof. In addition, the binder can include filler, such as nano-sized filler or a combination of nano-sized filler and micron-sized filler. In a particular embodiment, the binder is a colloidal binder, wherein the formulation that is cured to form the binder is a colloidal suspension including particulate filler. Alternatively, or in addition, the binder can be a nanocomposite binder including sub-micron particulate filler.

The binder generally includes a polymer matrix, which binds abrasive grains to the backing or compliant coat, if present. Typically, the binder is formed of cured binder formulation. In one exemplary embodiment, the binder formulation includes a polymer component and a dispersed phase.

The binder formulation can include one or more reaction constituents or polymer constituents for the preparation of a polymer. A polymer constituent can include a monomeric molecule, a polymeric molecule, or a combination thereof. The binder formulation can further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents can include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation can include a monomer, an oligomer, a polymer, or a combination thereof. In a particular embodiment, the binder formulation includes monomers of at least two types of polymers that when cured can crosslink. For example, the binder formulation can include epoxy constituents and acrylic constituents that when cured form an epoxy/acrylic polymer.

Size Coat

The abrasive flap can comprise a size coat overlying the abrasive layer. The size coat can be the same as or different from the polymer binder composition used to form the abrasive layer. The size coat can comprise any conventional compositions known in the art that can be used as a size coat. In an embodiment, the size coat comprises a conventionally known composition overlying the polymer binder composition of the abrasive layer. In another embodiment, the size coat comprises the same ingredients as the polymer binder composition of the abrasive layer. In a specific embodiment, the size coat comprises the same ingredients as the polymer binder composition of the abrasive layer and one or more additives. In a specific embodiment, the additive can be cryolite. In a specific embodiment, the size coated is essentially free of calcium carbonate.

Supersize Coat

The abrasive flap can comprise a supersize coat overlying the size coat. The supersize coat can be the same as or different from the polymer binder composition or the size coat composition. The supersize coat can comprise any conventional compositions known in the art that can be used as a supersize coat. In an embodiment, the supersize coat comprises a conventionally known composition overlying the size coat composition. In another embodiment, the supersize coat comprises the same ingredients as at least one of the size coat composition or the polymer binder composition of the abrasive layer. In a specific embodiment, the supersize coat comprises the same composition as the polymer binder composition of the abrasive layer or the composition of the size coat plus one or more grinding aids.

Suitable grinding aids can be inorganic based; such as halide salts, for example sodium cryolite, and potassium tetrafluoroborate; or organic based, such as sodium lauryl sulphate, or chlorinated waxes, such as polyvinyl chloride. In an embodiment, the grinding aid can be an environmentally sustainable material.

Additives

Any of the various polymeric compositions used to form the fabric backing; namely the reinforcing polymer composition (dip fill), front fill composition (front fill), and back fill composition (back fill); and the component layers of the abrasive flap; namely the binder (as a make coat or slurry coat), the size coat composition, and the supersize composition can comprise one or more additives.

Suitable additives can include grinding aids, fibers, lubricants, wetting agents, thixotropic materials, surfactants, thickening agents, pigments, dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. The amounts of these additive materials can be selected to provide the properties desired. These optional additives may be present in any part of the overall system of the coated abrasive product according to embodiments of the present disclosure.

Flap Configurations

The flaps of the flap wheel can have a particular beneficial configuration. A beneficial configuration can include specific flap size, flap shape, flap arrangement, or a combination thereof. In an embodiment, the flaps can be straight flaps, curved flaps, bent flaps, curled flaps, or a combination thereof. In a specific embodiment, the flaps that extend from the hub are straight. In another specific embodiment, the flaps that extend from the hub are curled (as viewed from the side).

Straight flaps can be further processed to produce curved flaps or curled flaps. Such processing can include humidification, heat setting, water wetting, mechanically rolling, compressing, drying, or a combination thereof. In one embodiment, curled flaps can be produced by humidifying and compressing the flaps. In another embodiment, curled flaps can be produced by heating the flaps and mechanically rolling, and compressing the heated flaps. In another embodiment, curled flaps can be produced by wetting the flaps, mechanically rolling, and compressing the flaps, and drying the flaps.

Embodiment 1

A flap wheel comprising: a hub, a plurality of abrasive flaps, wherein the plurality of abrasive flaps are circumferentially disposed about said hub, wherein the abrasive flaps comprise a fabric backing, and an abrasive layer disposed on the fabric backing, wherein the fabric backing comprises a fabric and a reinforcing polymer composition dispersed throughout the fabric, wherein the fabric comprises yarns in a warp direction and yarns in a weft direction, wherein the yarns in the warp direction comprise a blend of natural fibers and synthetic fibers, and wherein the yarns in the weft direction comprise natural fibers.

Embodiment 2

The flap wheel of embodiment 1, wherein the abrasive flaps further comprise a front fill composition disposed on the fabric backing between the fabric backing and the abrasive layer.

Embodiment 3

The flap wheel of embodiment 2, wherein the abrasive flaps further comprise a back fill composition disposed on a side of the fabric backing opposite the abrasive layer.

Embodiment 4

The flap wheel of embodiment 1, wherein the abrasive flaps further comprise a size coat disposed over the abrasive layer.

Embodiment 5

The flap wheel of embodiments 1, wherein the fabric is woven fabric.

Embodiment 6

The flap wheel of embodiment 5, wherein the woven fabric comprises a plain weave, a satin weave, a twill weave, or a combination thereof.

Embodiment 7

The flap wheel of embodiment 6, wherein the woven fabric comprises a 2 up 1 down twill weave.

Embodiment 8

The flap wheel of embodiments 1, wherein each of the yarns in the weft direction comprises at least one natural fiber, wherein the at least one natural fiber comprises a cut filament, a continuous filament, or a combination thereof.

Embodiment 9

The flap wheel of embodiment 1, wherein each of the yarns in the warp direction comprises at least one natural fiber and at least one synthetic fiber, wherein at least one natural fiber and at least one synthetic fiber comprise cut filaments, continuous filaments, or a combination thereof.

Embodiment 10

The flap wheel of embodiment 1, wherein each of the yarns in the fabric comprises a spun yarn, a plied yarn, a braided yarn, a roving, a twisted yarn, a flat yarn, a cabled yarn, a tow, or a combination thereof.

Embodiment 11

The flap wheel of embodiment 1, wherein the yarns in the weft direction comprise at least about 50% natural fibers, at least about 60% natural fibers, at least about 75% natural fibers, at least about 85% natural fibers, at least about 95% natural fibers, at least about 99% natural fibers.

Embodiment 12

The flap wheel of embodiment 11, wherein the yarns in the weft direction consist essentially of natural fibers.

Embodiment 13

The flap wheel of embodiments 1, wherein each of the yarns in the warp direction comprise at least about 30% synthetic fibers, at least about 40% synthetic fibers, at least about 50% synthetic fibers, at least about 60% synthetic fibers, at least about 75% synthetic fibers, at least about 85% synthetic fibers, at least about 95% synthetic fibers.

Embodiment 14

The flap wheel of embodiment 13, wherein each of the yarns in the warp direction comprise approximately 65% synthetic fibers.

Embodiment 15

The flap wheel of embodiments 1, wherein each of the yarns in the warp direction comprise less than about 70% natural fibers, less than about 60% natural fibers, less than about 50% natural fibers, less than about 40% natural fibers, less than about 25% natural fibers, less than about 10% natural fibers, less than about 55% natural fibers.

Embodiment 16

The flap wheel of embodiment 15, wherein each of the yarns in the warp direction comprise approximately 35% natural fibers.

Embodiment 17

The flap wheel of embodiments 1, wherein the natural fibers comprise cellulose, cotton, flax, hemp, jute, ramie, sisal, linen, silk, or a combination thereof.

Embodiment 18

The flap wheel of embodiment 17, wherein the natural fibers comprise cotton.

Embodiment 19

The flap wheel of embodiment 17, wherein the natural fibers consist essentially of cotton.

Embodiment 20

The flap wheel of embodiments 1, wherein the synthetic fibers comprise polymer, glass, metal, rubber, carbon, or a combination thereof.

Embodiment 21

The flap wheel of embodiment 20, wherein the synthetic fibers comprise polymer.

Embodiment 22

The flap wheel of embodiment 21, wherein the polymer comprises nylon, acrylic, olefin, polyester, rayon, modal, Dyneema, or a combination thereof.

Embodiment 23

The flap wheel of embodiment 22, wherein the polymer comprises polyester.

Embodiment 24

The flap wheel of embodiment 22, wherein the synthetic fibers consist essentially of polyester.

Embodiment 25

The flap wheel of embodiment 1, wherein the fabric comprises a yarn count of approximately 12×16, approximately 16×16, approximately 21×21, approximately 16×21, approximately 40×40.

Embodiment 26

The flap wheel of embodiment 1, wherein the fabric comprises at least about 20 warp yarns per inch, at least about 30 warp yarns per inch, at least about 40 warp yarns per inch, at least about 50 warp yarns per inch, at least about 60 warp yarns per inch, at least about 75 warp yarns per inch, at least about 85 warp yarns per inch.

Embodiment 27

The flap wheel of embodiment 26, wherein the fabric comprises at least about 78 warp yarns per inch.

Embodiment 28

The flap wheel of embodiment 1, wherein the fabric comprises at least about 5 weft yarns per inch, at least about 10 weft yarns per inch, at least about 20 weft yarns per inch, at least about 30 weft yarns per inch, at least about 40 weft yarns per inch, at least about 50 weft yarns per inch, at least about 60 weft yarns per inch.

Embodiment 29

The flap wheel of embodiment 28, wherein the fabric comprises at least about 48 weft yarns per inch.

Embodiment 30

The flap wheel of embodiment 1, wherein the fabric comprises a fabric weight of not less than 50 GSM, not less than 75 GSM, not less than 100 GSM, or not less than 125 GSM.

Embodiment 31

The flap wheel of embodiment 1, wherein the fabric comprises a fabric weight of not greater than 500 GSM, not less than 400 GSM, not less than 350 GSM, or not less than 300 GSM.

Embodiment 32

The flap wheel of embodiment 1, wherein the reinforcing polymer composition comprises an acrylic resin, a phenolic formaldehyde resin, a melamine formaldehyde resin, a urea formaldehyde resin, or combinations and blends thereof.

Embodiment 33

The flap wheel of embodiment 31, wherein the reinforcing polymer composition comprises an acrylic resin, a urea formaldehyde resin, or a combination thereof.

Embodiment 34

The reinforcing polymer composition of embodiment 33, comprising 3 wt % to 43 wt % acrylic resin and 57 wt % to 97 wt % urea formaldehyde resin.

Embodiment 35

The flap wheel of embodiment 1, wherein the reinforcing polymer composition comprises about 9 wt % to 14 wt % of the fabric backing.

Embodiment 36

The flap wheel of embodiment 1, wherein the reinforcing polymer composition comprises 35 GSM to 55 GSM of the fabric backing.

Embodiment 37

The flap wheel of embodiment 2, wherein the front fill is a polymeric composition comprising an acrylic resin, a phenolic formaldehyde resin, a melamine formaldehyde resin, a urea formaldehyde resin, or combinations and blends thereof.

Embodiment 38

The flap wheel of embodiment 37, wherein the front fill comprises an acrylic resin, a phenol formaldehyde resin, or combinations thereof.

Embodiment 39

The flap wheel of embodiment 38, comprising 15 wt % to 50 wt % acrylic resin and 50 wt % to 85 wt % phenol formaldehyde resin.

Embodiment 40

The flap wheel of embodiment 2, wherein the front fill comprises about 10 wt % to 15 wt % of the fabric backing.

Embodiment 41

The flap wheel of embodiment 2, wherein the front fill comprises 40 GSM to 60 GSM of the fabric backing.

Embodiment 42

The flap wheel of embodiment 3, wherein the back fill comprises an acrylic resin, a phenolic formaldehyde resin, a melamine formaldehyde resin, a urea formaldehyde resin, a natural glue, a starch, or a combination thereof.

Embodiment 43

The flap wheel of embodiment 3, wherein the back fill comprises about 5 wt % to 9 wt % of the fabric backing.

Embodiment 44

The flap wheel of embodiment 3, wherein the back fill comprises 20 GSM to 35 GSM of the fabric backing.

Embodiment 45

The flap wheel of embodiment 3, wherein the back fill is essentially free of filler particles, such as essentially free of calcium carbonate.

Embodiment 46

The flap wheel of embodiment 1, wherein the abrasive layer comprises abrasive particles disposed on or in a polymeric binder composition.

Embodiment 47

The flap wheel of embodiment 46, wherein the binder composition comprises a phenolic polymer such as resole and novolac polymer; a phenolic/latex polymer; an epoxy polymer such as bisphenol epoxy polymer; an isocyanate; an isocyanurate; a polysiloxane polymer including alkylalkoxysilane polymer; a reactive vinyl polymer, or combinations thereof.

Embodiment 48

The flap wheel of embodiment 46, wherein the abrasive particles comprise silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery, or combinations thereof.

Embodiment 49

The flap wheel of embodiment 4, wherein the size coat comprises a phenolic polymer such as resole and novolac polymer; a phenolic/latex polymer; an epoxy polymer such as bisphenol epoxy polymer; an isocyanate; an isocyanurate; a polysiloxane polymer including alkylalkoxysilane polymer; or a reactive vinyl polymer, or combinations thereof.

Embodiment 50

The flap wheel of any one of embodiment 1, 37, 42, 47, or 49, wherein the reinforcing polymer, the front fill, the back fill, the binder composition, or the size coat further comprises grinding aids, fibers, lubricants, wetting agents, thixotropic materials, surfactants, thickening agents, pigments, dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, or defoamers.

Embodiment 51

A method of making a flap wheel comprising: saturating a fabric with a polymer reinforcing composition to a fabric backing, disposing an abrasive layer on the fabric backing to form an abrasive flap, and disposing a plurality of abrasive flaps circumferentially about a hub to form a flap wheel, wherein the fabric comprises yarns in a warp direction and yarns in a weft direction, wherein the yarns in the warp direction comprise a blend of natural fibers and synthetic fibers, and wherein the yarns in the weft direction comprise natural fibers

EXAMPLES

Example 1

Making Abrasive Flap Wheels

A. Abrasive Flaps

Several samples of inventive and conventional abrasive flaps were prepared by preparing a fabric backing, including a reinforcing polymer, a front fill, and a back fill. Details of the fabrics are shown below in Table 1. Details of the reinforcing polymer, front fill, and back fill are shown in Table 2

TABLE 1

Fabrics

| Sample | C1 Comparative | C2 Comparative | S1 Inventive |
|---|---|---|---|
| Weave (twill) | 2 × 1 | 2 × 1 | 2 × 1 |
| Weight (GSM) | 230-260 | 230-260 | 230-260 |
| Yarn Number (warp × weft) | 12 × 16 | 12 × 16 | 12 × 16 |
| Count (threads per 25 mm) | 78 × 48 | 78 × 48 | 78 × 48 |
| Tensile Str (Kg/25 mm) | warp - 56 (min.) weft - 20 (min.) | warp - 75 (min.) weft - 25 (min.) | warp - 75 (min.) weft - 20 (min.) |
| Yarn Type ((warp × weft) | warp - cotton weft - cotton | warp - poly cotton weft - poly cotton | warp - poly cotton weft - cotton |
| Blend Ratio | 100% cotton | polyester - 65% cotton - 35% | polyester - 65% cotton - 35% |

TABLE 2

Fabric Treatment Compositions

| | C1 Comparative | C2 Comparative | S1 Inventive |
|---|---|---|---|
| Reinforcing Polymer | | | |
| Urea Formaldehyde (wt %) | 0 | 77 | 77 |
| Acrylic Laytex (wt %) | 83 | 23 | 23 |
| Melamine Formaldehyde (wt %) | 17 | 0 | 0 |
| Add-On (GSM) | 25-32 | 40-50 | 40-50 |
| Front Fill | | | |
| Glue | 76 | 76 | 76 |
| Starch | 24 | 24 | 24 |
| Add-On | 25-30 | 25-30 | 25-30 |

TABLE 2-continued

| Fabric Treatment Compositions | | | |
|---|---|---|---|
| | C1 Comparative | C2 Comparative | S1 Inventive |
| Back Fill | | | |
| Acrylic Laytex (wt %) | 43 | 14 | 33 |
| Phenol Formaldehyde (wt %) | 22 | 70 | 67 |
| Calcium Carbonate | 35 | 16 | 0 |
| Add-On (GSM) | 60-70 | 100-120 | 45-55 |

An abrasive layer, including make coat, abrasive particles, and size coat was applied to the fabric backing to form a plurality of abrasive flaps. The abrasive flaps were disposed on a central hub to construct an abrasive flap wheel. Details of the layers of the abrasive flap are shown in Table 3.

TABLE 3

| Abrasive Layer | | | |
|---|---|---|---|
| | C1 Comparative | C2 Comparative | S1 Inventive |
| Make Coat | | | |
| Phenol Formaldehyde (wt %) | 45 | 57 | 57 |
| Calcium Carbonate (wt %) | 55 | 0 | 0 |
| Wollastonite (wt %) | 0 | 43 | 43 |
| Abrasive Particles | Brown Aluminum Oxide 60-1200 grit | Brown Aluminum Oxide 60-600 grit | Blue Fired Aluminum Oxide 60-120 grit Brown Aluminum Oxide 60-1200 grit |
| Size Coat | | | |
| Phenol Formaldehyde (wt %) | 67 | 67 | 67 |
| Calcium Carbonate (wt %) | 33 | 0 | 0 |
| Cryolite (wt %) | 0 | 33 | 33 |

Abrasive testing of the comparative and inventive abrasive flap wheels constructed in Example 1 was conducted.

Example 2

"Single Flap" Testing

Figure 6:
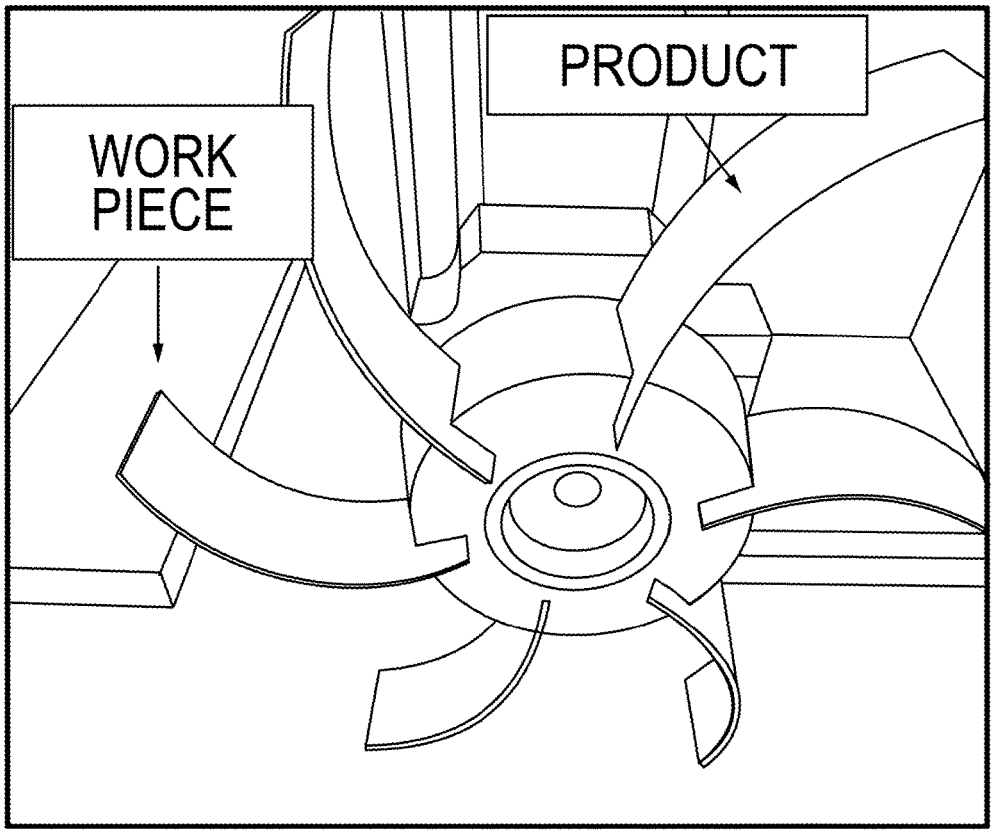
FIG. 6 is a photograph showing the test set up for Single Flap Testing

Single flap testing was conducted according to the following conditions. The single flap testing machine and workpiece set-up are shown in FIG. 6. Six single flaps of a sample were inserted into the machine and abrasion testing was conducted for ten minutes or until one of the six flaps broke, whichever occurred first. Measurements of the flap wear (weight loss) and reduction of flap length for each flap were measured and averaged for the six flaps. The total material removed (abraded) from the workpiece was recorded. The grind ratio (i.e., the material removed in grams divide by the flap wear in grams) was computed.

Work piece: stainless steel
Rotation speed: 1630 RPM under Load
Air line pressure under Load: 35 psi
Flap length: 86 mm
Flap width: 25 mm
Number of flaps: six
Flap contact on workpiece: 28 mm
Clamp length: 16 mm Inventive flap samples (Inv. 1, Inv. 2, Inv. 3, Inv. 4, Inv. 5, and Inv. 6) having the same construction as described above for S3 and an abrasive grit size of 120 grit (120#) were prepared and tested. Two control samples (Control 1, Control 2) having the same construction as described above for C1 and an abrasive grit size of 120 grit (120#) were prepared and tested. The results are shown below in Table. 4

TABLE 4

| Single Flap Testing | | | | |
|---|---|---|---|---|
| | Material Removed ("MR") (g) | Wear (g) | Grind Ratio (MR/Wear) (g) | Grind Ratio Comparison to Control Avg. |
| Control 1 | 0.36 | 0.95 | 0.36 | 1.17 |
| Control 2 | 0.27 | 1.0 | 0.27 | 0.84 |
| Control Avg. | 0.32 | 0.98 | 0.32 | 1.00 |
| Inventive 1 | 0.39 | 0.45 | 0.87 | 2.68 |
| Inventive 2 | 0.41 | 0.55 | 0.75 | 2.31 |
| Inventive 3 | 0.37 | 0.6 | 0.62 | 1.91 |
| Inventive 4 | 0.51 | 0.57 | 0.89 | 2.77 |
| Inventive 5 | 0.29 | 0.37 | 0.78 | 2.43 |
| Inventive 6 | 0.45 | 0.42 | 1.07 | 3.32 |
| Inventive Avg. | 0.40 | 0.49 | 0.82 | 2.53 |

As is shown by the test results, all the inventive flap wheel samples produced a higher total material removal, a lower flap wear, and a higher grind ratio compared to the control samples. Notably, all the inventive samples beneficially produced an unexpectedly higher grind ratio than the control samples. In particular, the inventive samples produced higher grind ratios that varied from a low of 191% (Inv. 3) to a high of 332% (Inv. 6) of the Control Average grind ratio. Further, the Inventive Average grind ratio was 253% that of the Control average grind ratio.

Example 3

Small Diameter Flap Wheel Testing

Figure 7:
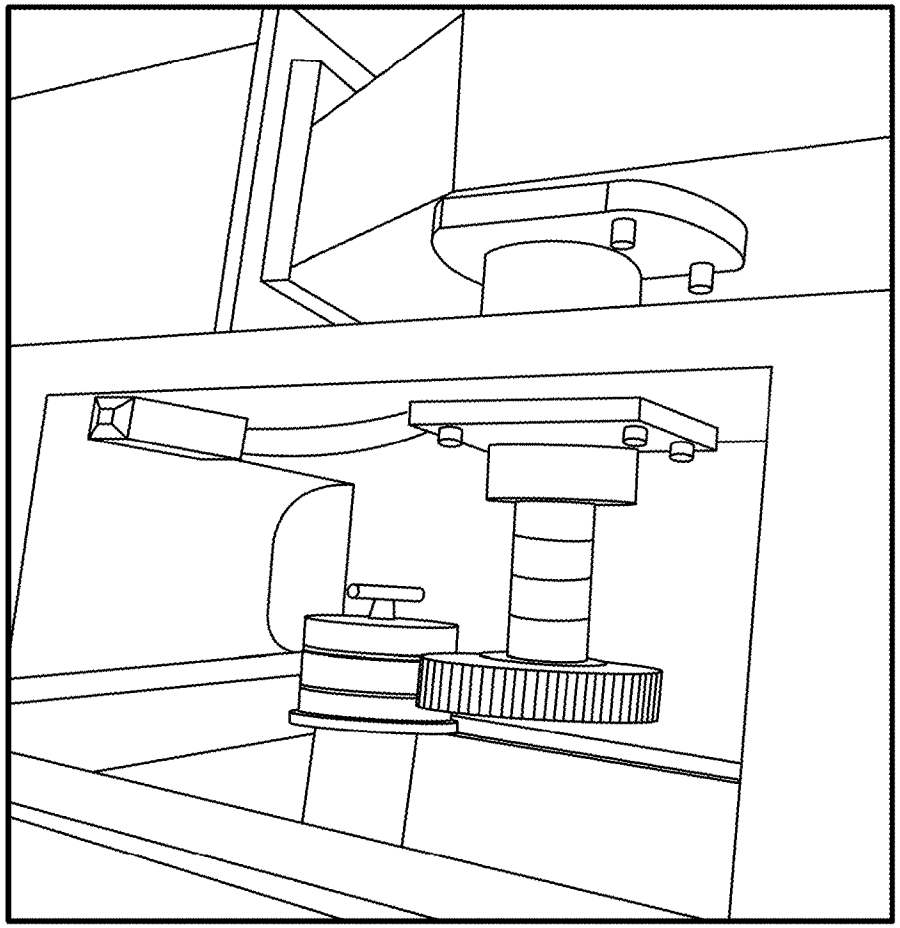
FIG. 7 is a photograph showing the test set up for Small Diameter Flap Wheel Testing.

Small diameter flap wheel testing was conducted according to the following conditions. The flap wheel testing machine and workpiece set-up are shown in FIG. 7. The flap wheel samples were mounted onto the machine and abrasion testing was conducted on the work piece until the flaps were worn down to a remaining flap length of 5-8 mm (i.e., at least 24 mm of flap length was worn away). Measurements of the total grinding time, total material removed from the workpiece, flap wear (length of flap loss), and Grind Ratio (i.e., the work piece material removed in grams divide by the length of flap wear loss) were recorded.

Grinding Wheel Dimensions: 150 mm dia×31.75 mm bore×25 mm width
Work piece: stainless steel 202
Rotation speed: 2500 RPM under Load
Load: 7 kg
Flap width: 25 mm
Grinding Cycle: 60 seconds Inventive flap wheels and Control flap wheels having different size abrasive grits: 60 grit (60#), 80 grit (80#), 120 grit (120#), and 220 grit (220#) were tested. The results are shown below in Table. 5

TABLE 5

Small Diameter Flap Wheel Testing

| | Grit Size | Material Removed ("MR") (g) | Time (min) | Wear (mm) | Grind Ratio (MR/Wear) (g/mm) | Grind Ratio Comparison to Control |
|---|---|---|---|---|---|---|
| Control | 60# | 217.6 | 80 | 27 | 8.06 | 1.00 |
| Inventive 3 | 60# | 973.8 | 250 | 26 | 37.45 | 4.65 |
| Control | 80# | 257.9 | 120 | 27 | 9.55 | 1.00 |
| Inventive 1 | 80# | 945 | 260 | 26 | 36.35 | 3.81 |
| Inventive 3 | 80# | 1109.6 | 300 | 26 | 42.68 | 4.47 |
| Inventive Avg. | 80# | 1027.3 | 280 | 26 | 39.51 | 4.14 |
| Control | 120# | 509.4 | 120 | 30 | 16.98 | 1.00 |
| Inventive 1 | 120# | 1007.2 | 310 | 24 | 41.97 | 2.47 |
| Inventive2 | 120# | 956 | 200 | 25 | 38.24 | 2.25 |
| Inventive 3 | 120# | 1014.6 | 260 | 25 | 40.58 | 2.39 |
| Inventive 4 | 120# | 1416.8 | 440 | 26 | 54.49 | 3.21 |
| Inventive 5 | 120# | 1689.8 | 540 | 27 | 62.59 | 3.69 |
| Inventive Avg. | 120# | 1216.9 | 350 | 25.4 | 47.57 | 2.80 |
| Control | 220# | 198 | 80 | 26 | 7.62 | 1.00 |
| Inventive 1 | 220# | 545 | 310 | 26 | 20.96 | 2.75 |
| Inventive 2 | 220# | 710 | 440 | 26 | 27.31 | 3.59 |
| Inventive 3 | 220# | 691.8 | 380 | 26 | 26.61 | 3.49 |
| Inventive Avg. | 220# | 648.9 | 376.7 | 26 | 24.96 | 3.28 |

As is shown by the test results, all the inventive flap wheel samples produced a higher total material removal and a higher grind ratio compared to the control samples. Notably, all the inventive samples beneficially produced unexpectedly higher grind ratios than the control samples. For the 60 grit flap wheels, the inventive sample produced a grind ratio that was 465% of the Control sample. For the 80 grit flap wheels, the inventive samples produced higher grind ratios that varied from a low of 381% (Inv. 1) to a high of 447% (Inv. 3) of the Control sample. Further, for the 80 grit flap wheels the Inventive Average grind ratio was 414% of the Control sample. For the 120 grit flap wheels, the inventive samples produced higher grind ratios that varied from a low of 225% (Inv. 2) to a high of 369% (Inv. 5) of the Control sample. Further, for the 120 grit flap wheels the Inventive Average grind ratio was 280% of the Control sample. For the 220 grit flap wheels, the inventive samples produced higher grind ratios that varied from a low of 275% (Inv. 1) to a high of 359% (Inv. 2) of the Control sample. Further, for the 120 grit flap wheels the Inventive Average grind ratio was 328% of the Control sample.

Example 4

Large Diameter Flap Wheel Testing

Figure 8:
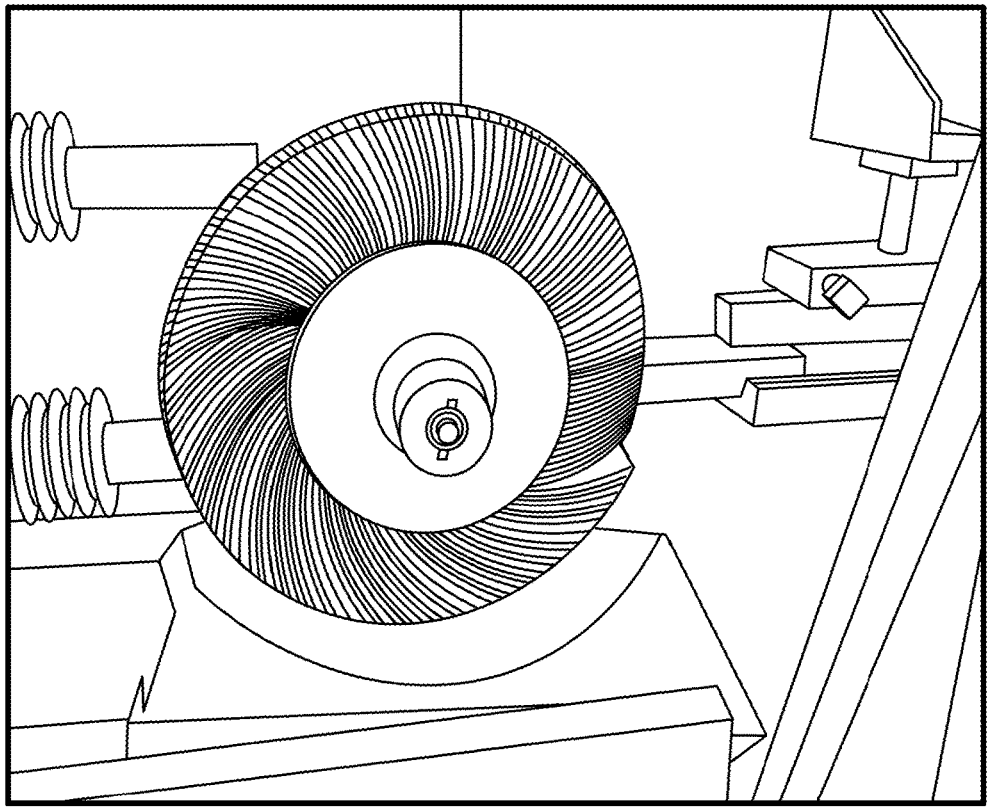
FIG. 8 is a photograph showing the test set up for Large Diameter Flap Wheel Testing.

Large diameter flap wheel testing was conducted according to the following conditions. The flap wheel testing machine and workpiece set-up are shown in FIG. 8. The flap wheel samples were mounted onto the machine and abrasion testing was conducted on the work piece until at least 15 mm of flap length was worn away. Measurements of the total material removed from the workpiece, flap wear (length of flap loss), and Grind Ratio (i.e., the work piece material removed in grams divide by the flap wear loss) were recorded.

Grinding Wheel Dimensions: 300 mm dia×127 mm bore×50 mm width

Work piece: stainless steel 304, 25 mm

Rotation speed: 2800 RPM under Load

Grinding Cycle: 20 seconds

Inventive and Control flap wheels having different size abrasive grits: 120 grit (120#), 220 grit (220#), and 320 grit (320#) were tested. The results are shown below in Table 6.

TABLE 6

Large Diameter Flap Wheel Testing

| | Grit Size | Material Removed ("MR") (g) | Wear (mm) | Grind Ratio (g/mm) | Grind Ratio Comparison to Control |
|---|---|---|---|---|---|
| Control | 120# | 475.2 | 16 | 29.70 | 1.00 |
| Inventive | 120# | 1276.6 | 17 | 75.09 | 2.53 |
| Control | 220# | 411.2 | 17 | 24.19 | 1.00 |
| Inventive | 220# | 678.8 | 15 | 45.25 | 1.87 |
| Control | 320# | 242.6 | 15 | 16.17 | 1.00 |
| Inventive | 320# | 754.8 | 17 | 44.40 | 2.75 |

As is shown by the test results, all the inventive flap wheel samples produced a higher total material removal and a higher grind ratio compared to the control samples. Notably, all the inventive samples beneficially produced unexpectedly higher grind ratios than the control samples. For the 120 grit flap wheels, the inventive sample produced a grind ratio that was 253% of the Control sample. For the 220 grit flap wheels, the inventive sample produced a grind ratio that was 187% of the Control sample. For the 320 grit flap wheels, the inventive sample produced a grind ratio that was 275% of the Control sample.

Example 5

Cutting Temperature Test

Figure 9:
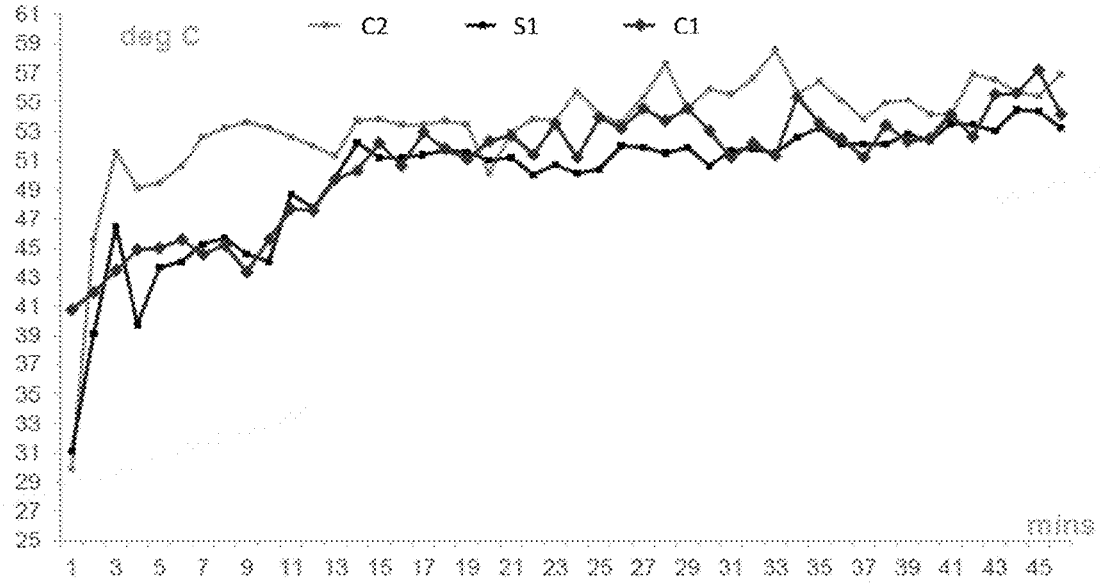
FIG. 9 is a graph comparing the abrasive surface temperature of inventive and conventional small diameter abrasive flap wheel during continuous abrasive testing.

A cutting temperature test was conducted using the same set up and conditions as the small diameter flap wheel abrasion test described above in Example 3, however continuous grinding was conducted for 45 minutes and the temperature of the abrasive surface was recorded once per minute. Control flap wheels C1 (cotton/cotton) and C2 (polycotton/polycotton) and inventive flap wheel S1 (polycotton/cotton) were tested and the results are shown in FIG. 9. As the graph shows, control wheel C2 generally produces a higher grinding temperature than control wheel C1 and inventive wheel S1. Beneficially, inventive wheel S1 produces a grinding temperature that is generally equal to and in most instances even lower than control C1. This is surprising because the inventive flap wheel has a polycotton warp and cotton weft construction but is still as cool or even cooler than a cotton warp and cotton weft construction.

Example 6

Surface Finish Testing

Figure 10:
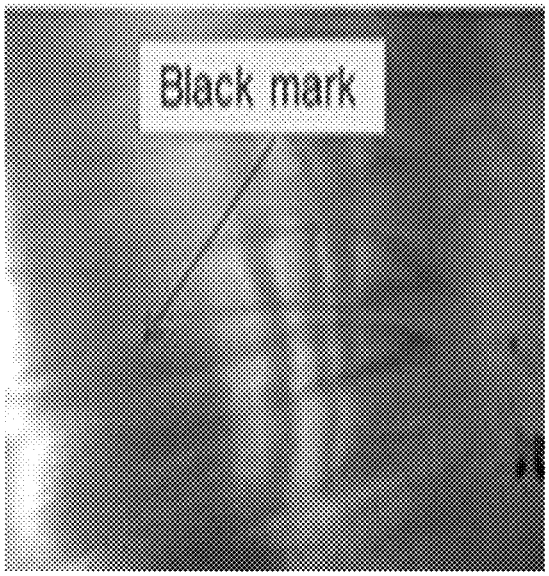
FIG. 10 is a photograph showing an unacceptable surface finish that is dark and has black marks produced by polishing a stainless steel surface with a conventional flap wheel.
Figure 11:
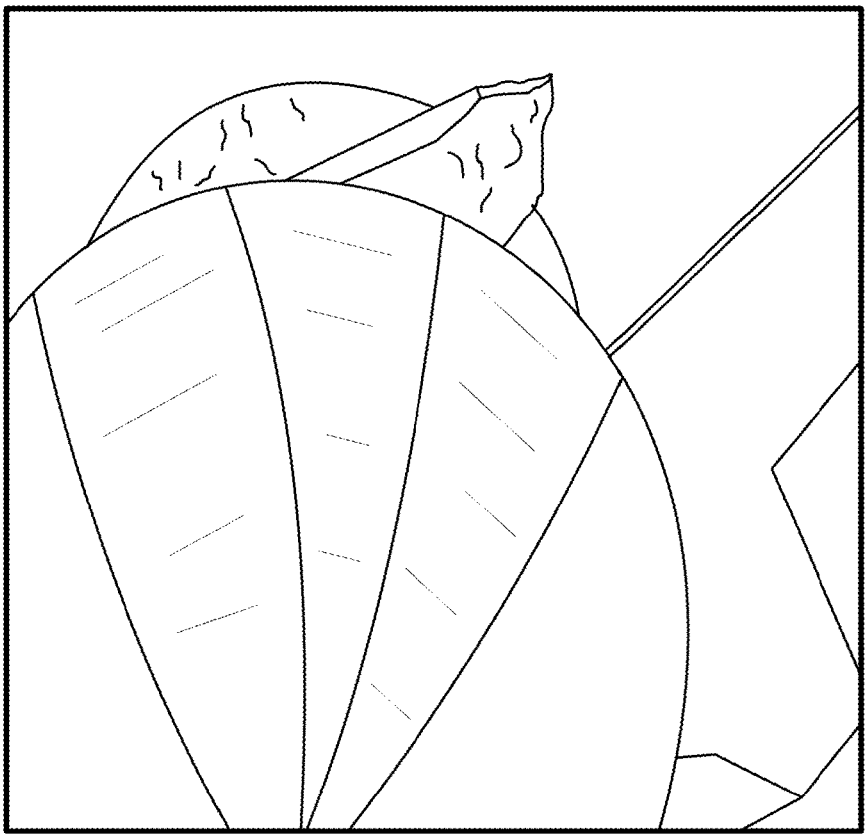
FIG. 11 is a photograph showing an acceptable bright shiny surface finish produced by polishing a stainless steel surface with an inventive flap wheel.
Figure 12:
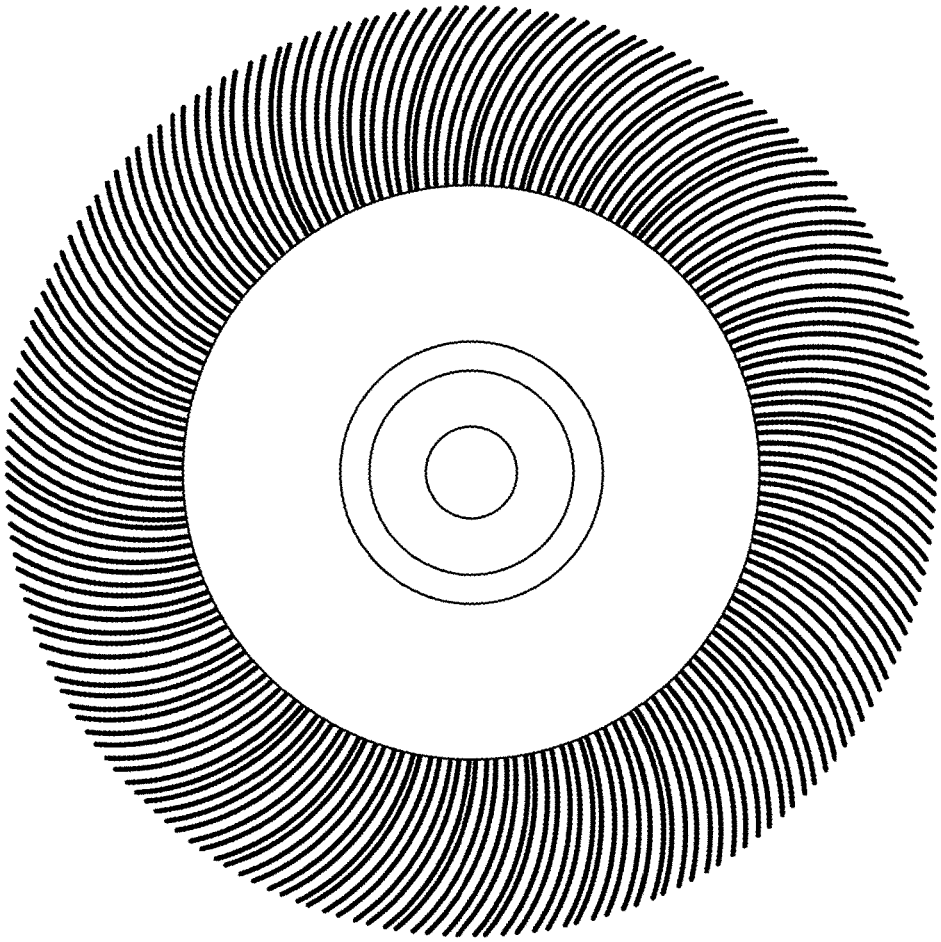
FIG. 12 is a photograph of an inventive flap wheel embodiment having curled flaps.

Stainless steel work pieces were polished using handheld grinders fitted with small diameter flap wheels. Control flap wheels C1 (cotton/cotton) and C2 (polycotton/polycotton) and inventive flap wheel S1 (polycotton/cotton) were tested and the surface finish of the workpieces was evaluated by visual inspection. Work pieces polished with control flap wheel C1 (cotton/cotton) produced a consistently bright shiny surface free of dark streaks that was deemed acceptable. In contrast, workpieces polished with control flap wheel C2 (polycotton/polycotton) produced a darker, less shiny surface that had many noticeable dark streaks ("black marks"), as shown in FIG. 10, and were deemed unacceptable. Beneficially and surprisingly, workpieces that were polished with inventive flap wheel S1 (polycotton/cotton) produced a consistently bright shiny surface that was free of dark streaks, as shown in FIG. 11, that was deemed acceptable.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity can not be required, and that one or more further activities can be performed in addition to those described. Still further, the order in which activities are listed is not necessarily the order in which they are performed.

The disclosure is submitted with the understanding that it will not be used to limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Thus, to the maximum extent allowed by law, the scope of the present invention is to be determined by the broadest permissible interpretation of the following claims and their equivalents, and shall not be restricted or limited by the foregoing detailed description.

What is claimed is:

1. A flap wheel comprising:
a hub,
a plurality of abrasive flaps,
wherein the plurality of abrasive flaps are circumferentially disposed about said hub,
wherein each of the abrasive flaps comprises
a fabric backing, and
an abrasive layer disposed on the fabric backing,
wherein the fabric backing comprises a fabric and a reinforcing polymer composition dispersed throughout the fabric,
wherein the fabric comprises yarns in a warp direction and yarns in a weft direction,
wherein the yarns in the warp direction comprise a blend of natural fibers and synthetic fibers,
wherein the yarns in the weft direction comprise natural fibers, and
wherein the reinforcing polymer composition comprises
3 wt % to 43 wt % acrylic resin and
57 wt % to 97 wt % urea formaldehyde resin.

2. The flap wheel of claim 1, wherein each of the abrasive flaps further comprises a front fill composition disposed on the fabric backing between the fabric backing and the abrasive layer.

3. The flap wheel of claim 2, wherein each of the abrasive flaps further comprises a back fill composition disposed on a side of the fabric backing opposite the abrasive layer.

4. The flap wheel of claim 3, wherein the back fill comprises a natural glue, a starch, or a combination thereof.

5. The flap wheel of claim 3, wherein the back fill comprises about 5 wt % to 9 wt % of the fabric backing.

6. The flap wheel of claim 2, wherein the front fill is a polymeric composition comprising
15 wt % to 50 wt % acrylic resin and
50 wt % to 85 wt % phenolic formaldehyde resin.

7. The flap wheel of claim 2, wherein the front fill comprises about 10 wt % to 15 wt % of the fabric backing.

8. The flap wheel of claim 1, wherein the fabric is a woven fabric comprising a plain weave, a satin weave, a twill weave, or a combination thereof.

9. The flap wheel of claim 1, wherein the yarns in the weft direction comprise at least about 50% natural fibers.

10. The flap wheel of claim 1, wherein the yarns in the weft direction consist essentially of natural fibers.

11. The flap wheel of claim 1, wherein each of the yarns in the warp direction comprise at least about 30% synthetic fibers and less than about 70% natural fibers.

12. The flap wheel of claim 1, wherein the natural fibers consist essentially of cotton.

13. The flap wheel of claim 1, wherein the synthetic fibers consist essentially of polyester.

14. The flap wheel of claim 1, wherein the fabric comprises at least about 20 warp yarns per inch and at least about 5 weft yarns per inch.

15. The flap wheel of claim 1, wherein the fabric comprises a fabric weight of not less than 50 GSM and not greater than 500 GSM.

16. The flap wheel of claim 1, wherein the reinforcing polymer composition comprises about 9 wt % to 14 wt % of the fabric backing.

17. The flap wheel of claim 1, wherein the fabric backing comprises a tensile strength in the warp direction of at least 15 kg/.

18. The flap wheel of claim 1, wherein the fabric backing comprises a tensile strength in the weft direction of at least 70 kg/25 mm.

19. A flap wheel comprising:
a hub,
a plurality of abrasive flaps,
wherein the plurality of abrasive flaps are circumferentially disposed about said hub,
wherein each of the abrasive flaps comprises
a fabric backing, and
an abrasive layer disposed on the fabric backing,
wherein the fabric backing comprises a fabric and a reinforcing polymer composition dispersed throughout the fabric,
wherein the fabric comprises yarns in a warp direction and yarns in a weft direction,
wherein the yarns in the warp direction comprise a blend of natural fibers and synthetic fibers,
wherein the yarns in the weft direction comprise natural fibers, and wherein the reinforcing polymer composition comprises about 9 wt % to 14 wt % of the fabric backing.

20. A flap wheel comprising:

a hub, a plurality of abrasive flaps, wherein the plurality of abrasive flaps are circumferentially disposed about said hub, wherein each of the abrasive flaps comprises a fabric backing, an abrasive layer disposed on the fabric backing, and a front fill composition disposed on the fabric backing between the fabric backing and the abrasive layer, wherein the fabric backing comprises a fabric and a reinforcing polymer composition dispersed throughout the fabric, wherein the fabric comprises yarns in a warp direction and yarns in a weft direction, wherein the yarns in the warp direction comprise a blend of natural fibers and synthetic fibers, wherein the yarns in the weft direction comprise natural fibers, and wherein the front fill is a polymeric composition comprising 15 wt % to 50 wt % acrylic resin and 50 wt % to 85 wt % phenolic formaldehyde resin.

* * * * *